United States Patent [19]

Chesky

[11] Patent Number: 5,035,235

[45] Date of Patent: Jul. 30, 1991

[54] MUSIC VIBRATION TABLE AND SYSTEM

[76] Inventor: Kris S. Chesky, 1011 Avenue A, Denton, Tex. 76201

[21] Appl. No.: 542,907

[22] Filed: Jun. 25, 1990

[51] Int. Cl.[5] ..... A61H 1/00

[52] U.S. Cl. ..... 128/33; 128/24 R; 128/24.2

[58] Field of Search ..... 128/33, 54, 55, 64, 128/24 R, 24.2

[56] References Cited

U.S. PATENT DOCUMENTS

| | | | |
|---|---|---|---|
| 3,556,088 | 1/1971 | Leonard | 128/33 |
| 4,023,566 | 5/1977 | Martinmaas | 128/33 |
| 4,635,287 | 1/1987 | Hirano | 128/33 X |
| 4,753,225 | 6/1988 | Vögel | 128/33 |

*Primary Examiner*—Danton D. DeMille
*Assistant Examiner*—Brian E. Hanlon
*Attorney, Agent, or Firm*—John E. Vandigriff

[57] ABSTRACT

A music vibration table and a system used to control the table and analyze vibration distributions on the surface of the table are used for chronic and acute pain therapy.

11 Claims, 3 Drawing Sheets

MUSIC VIBRATION TABLE AND SYSTEM

FIELD OF THE INVENTION

This invention relates to vibration therapy tables, and more particularly to a fluctuating frequency vibration table and measurement system that includes music as a source of vibration.

BACKGROUND OF THE INVENTION

Vibration, when directly applied to the body, stimulates larger diameter cutaneous mechanoreceptors, particularly Pacinian corpuscles. Pacinian corpuscles are mediated by large diameter afferent fibers. When activated, they have an inhibitory affect on pain transmission from small diameter afferents. The inhibitory nature of activated larger afferents is believed responsible for changes in pain perception. This has been confirmed electroneurologically, behaviorally, and clinically. Prolonged exposer to a non-changing vibration causes the Pacinian corpuscle to adapt or accommodate to the stimulus, reducing the inhibitory nature of the large diameter afferent.

Music, fluctuating frequencies and amplitudes of sound, when used as the source of mechanical vibration, prolongs or possibly eliminates the onset of accommodation in the Pacinian corpuscle. When the large Pacinian corpuscles cease to accommodate, continued activation and firing causes prolonged and greater analgesia. The selected music must contain in its composition those frequencies that have been determined to be in the tracking range of the Pacinian corpuscle. This range includes frequencies between 60–600 Hz.

Music also influences pain perception because it distracts attention, stimulates aural perception, evokes emotion, mediates imagery, relaxes, stimulates, and influences anxiety states. Most importantly is the fact that most every human enjoys listening to music. Enhanced music vibration offers an aesthetic experience that is unique as well as therapeutic.

Some prior art studies deal with mechanical vibrations that are non-fluctuating oscillations, relative to frequency and amplitude, with no corresponding sound. These studies have utilized vibrations surface areas up to 600 $cm^2$ in attempts to alter pain perception.

There has been a music table marketed by Somasonics, Inc of Tampa Fla., however, this table uses body speakers and does not have feed back control and does not include a system to analyze the effects of various input frequencies on the frequency and amplitude of vibration on various parts of the table.

SUMMARY OF THE INVENTION

The invention is a music vibration table and a data acquisition system used in conjunction with the music vibration table (MVT) to measure stimulus of the table. The top of the MVT is a vibrating membrane that vibrates the subject. This membrane is vibrated through air pressure changes created by acoustic drives inside the table. Once the membrane is set in motion, it creates nodes and anti-nodes of vibration dependent upon the particular frequencies of the oscillating sound pressure. Using an oscillator, the frequency can be changed resulting in a change of the vibrating pattern. The amplitude of vibration changes with frequency and loudness level.

Measurement of the amplitude of vibration may be accomplished in several ways, i.e. laser beam deflection and accelerometer. Measurements made with these instruments change considerably when a body is on the table. The mass and displacement of each individual causes the membrane to vibrate differently.

Transducers are used that do not need electrical input. Such transducers include piezoelectric transducers. Piezoelectric transduces work on the principal that certain crystalline materials produce significant electrical voltages when subject to mechanical strain. When the piezoelectric element is bent or strained, an amount of voltage is produced that is proportional to the amount of bend.

The MVT has a grid of piezeolectric elements suspended under the vibrating membrane and is connected to the membrane with rigid rods. Rods of ceramic, plastic or glass may be used. Any movement of the membrane induces a voltage in the transducer proportional to the vibration of the membrane at the point at which the rod attached to the transducer is attached to the membrane. The weight and mass of an individual will not effect the measure of the voltage induced in the transducer because once the person is on the table, the transduces will react as if the position of the membrane, due to the person thereon, is in a static position. The system is capable of measuring high frequencies very rapidly so that signals from each location on the grid can be read before the phase of the measured oscillation changes.

The measurement system includes a processor for receiving signals from the transducers that have been converted from an analog to a digital signal. The processor provides an output to a data storage device and a plotter that may be used to plot a pattern of vibration responses of the table. Feedback from the processor may be used to vary vibration patterns of the table.

The technical advance represented by the invention as well as the objects thereof will become apparent from the following description of a preferred embodiment of the invention when considered in conjunction with the accompanying drawings, and the novel features set forth in the appended claims.

PREFERRED EMBODIMENT OF THE INVENTION

Figure 1:
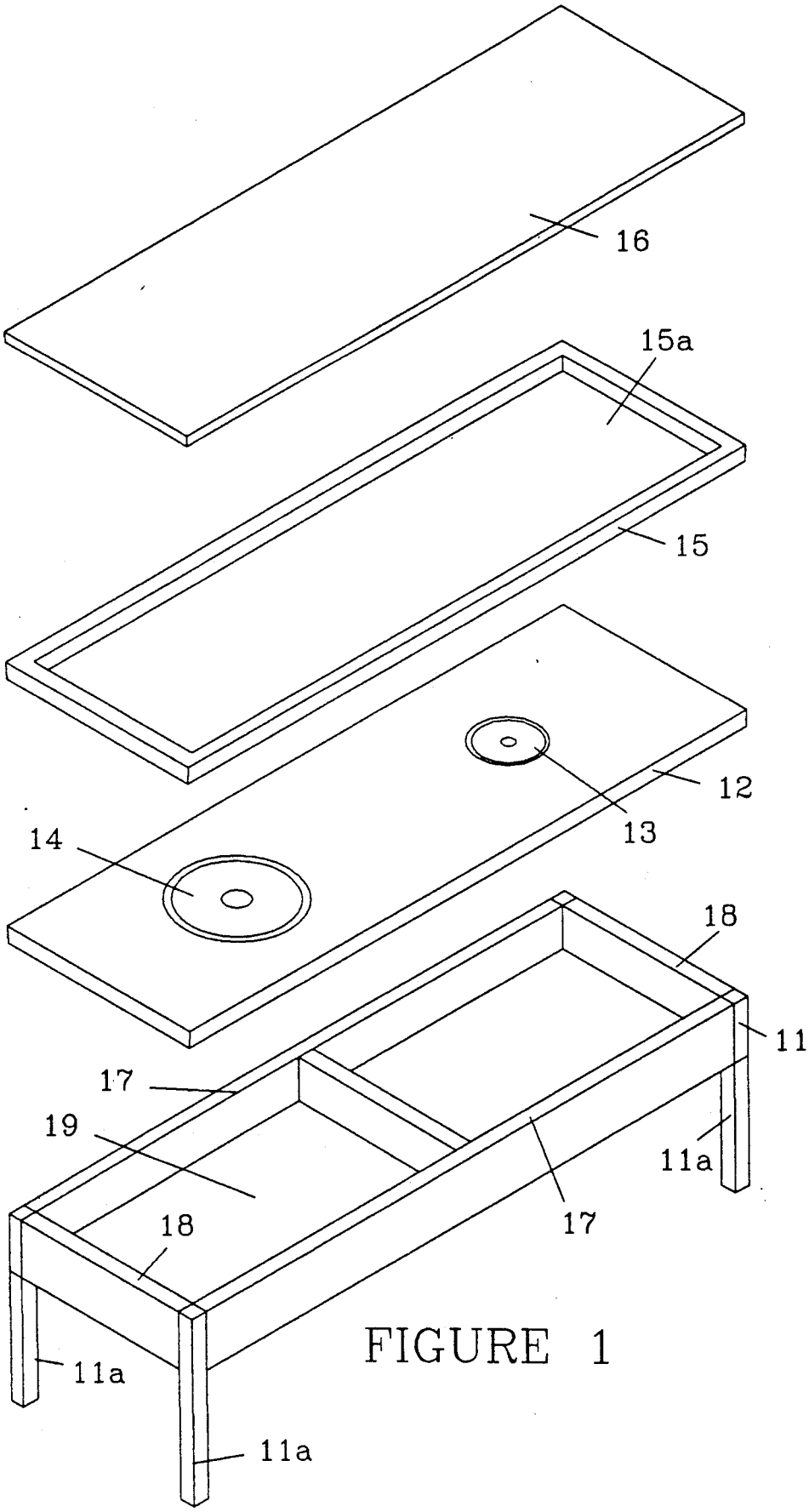
FIG. 1 is an exploded view of the Music Vibration Table.

FIG. 1 is an exploded view of the Music Vibration Table (MVT) illustrating the basic elements of the table. Table 10 includes a Base 11 including sides 17 and 18 supported by four legs 11*a*. A sound source mounting surface 12 has two acoustic transducers 13 and 14 mounted on the mounting surface 12. More than two sound sources may be used depending upon the amount of vibration power desired. Panel 19 encloses the under side of the table to form an acoustic cavity for transducers 13 and 14. A frame 15 is mounted on the sound source mounting surface 12. A flexible membrane 16 is mounted on frame 15. Flexible membrane 16 may be of metal. In one embodiment, the flexible membrane was constructed of non-tempered steel 1/32 inch thick. The membrane may be of aluminum or even of a plastic. The membrane is secured to frame 12 around it periphery. Frame 15 as well as mounting surface 12 are secured to table 11.

An enclosed cavity 15*a* is formed between membrane 15 and mounting surface 12 by frame 15. When sound or music is applied to transducers 13 and 14, the air enclosed in cavity 15*a* is put into motion by the sound and/or music applied to transducers 13 and 14 causing membrane 16 to vibrate at a frequency corresponding to the frequencies of the sound and music. The amplitude of vibration is based on the power of the sound or music applied to transducers 13 and 14.

Figure 2:
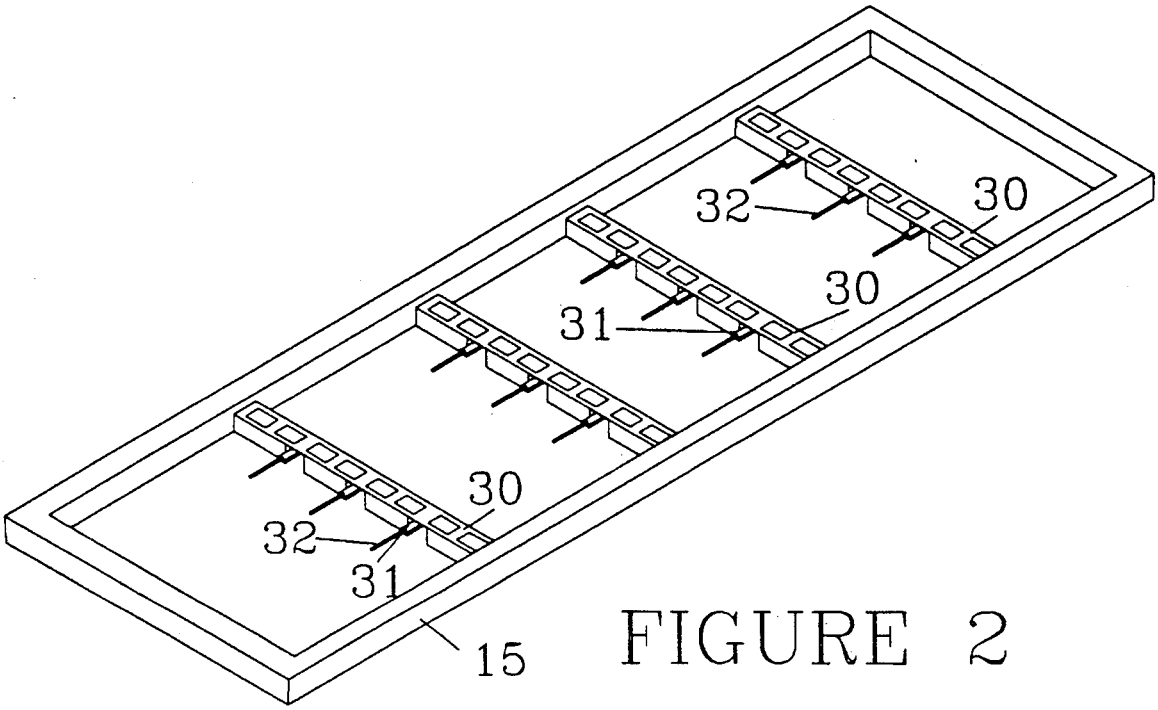
FIG. 2 illustrates an array of transduces for sensing vibration of the table membrane.
Figure 3:
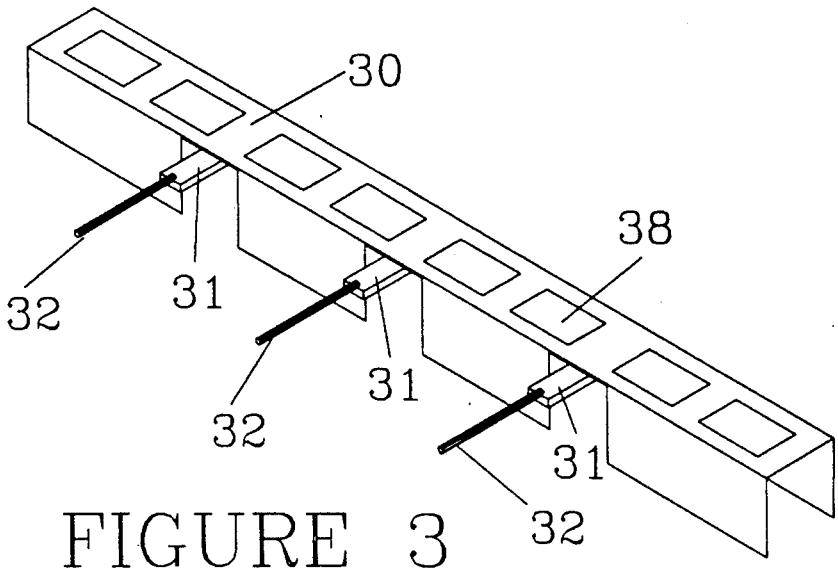
FIG. 3 is an enlarged view of the transducers and connection rods.

FIG. 2 shows frame 15 with a grid of transducers thereon. FIG. 3 is an enlarged view of the sensor transducers on frame 15. FIG. 2 shows a grid of 12 transducers 31 mounted on supports 30. Transducers 31 are rigidly secured to supports 30, for example, with an epoxy cement, which are mounted within frame 15. Each transducer 31 has a rod 32 secured thereto at one end. The other end of each rod 32 is secured to membrane 16 (not illustrated) by an epoxy cement or RTV adhesive. The number of transducers is dependent upon the degree of feedback desired from the vibrating membrane. More or less transducers 31 can be used.

Support 30 has a plurality of slots 38 therein to reduce vibration of the support. Rods 32 may be, for example, glass, ceramic or plastic, and may be either solid or in the form of a tube. The important characteristic of rod 32 is that it transmits vibrations of membrane 16 to transducer 31.

Figure 4A:
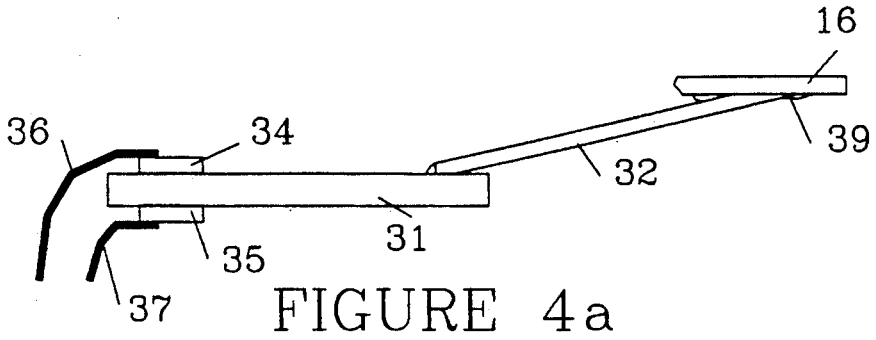
FIG. 4*a* illustrates the transducer, rods and connections to the transducer.

FIG. 4*a* illustrates transducers 31, the electrical connections thereto, and the connection of the rod 32 between transducer 31 and membrane 16. The rod 32 is connected to membrane 16 by, for example, an epoxy 39. Connection plates 34 and 35 are electrically connected to each side of transducer 31. A wire, wires 36 and 37, is connected to each plate 34 and 35. As transducer 31 is flexed due to vibrations of membrane 16, an electrical voltage is produced in transducer 31 dependent upon the amount of flexing of the transducer. This voltage is transmitted to the measurement system described below with reference to FIG. 5. The end of rod 32 is shown connected to membrane with adhesive 39.

Figure 4B:
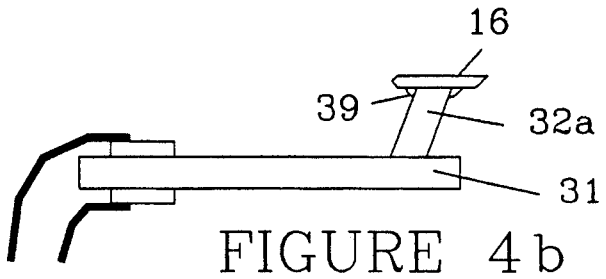
FIG. 4*b* illustrates another embodiment of the transducer, rods and connections to the transducer.

FIG. 4*b* shows a second embodiment for mounting rod 32 between membrane 16 and transducer 31. Rod 32*a* may be mounted between membrane 16 and transducer 31 at an incline, or vertically.

Figure 5:
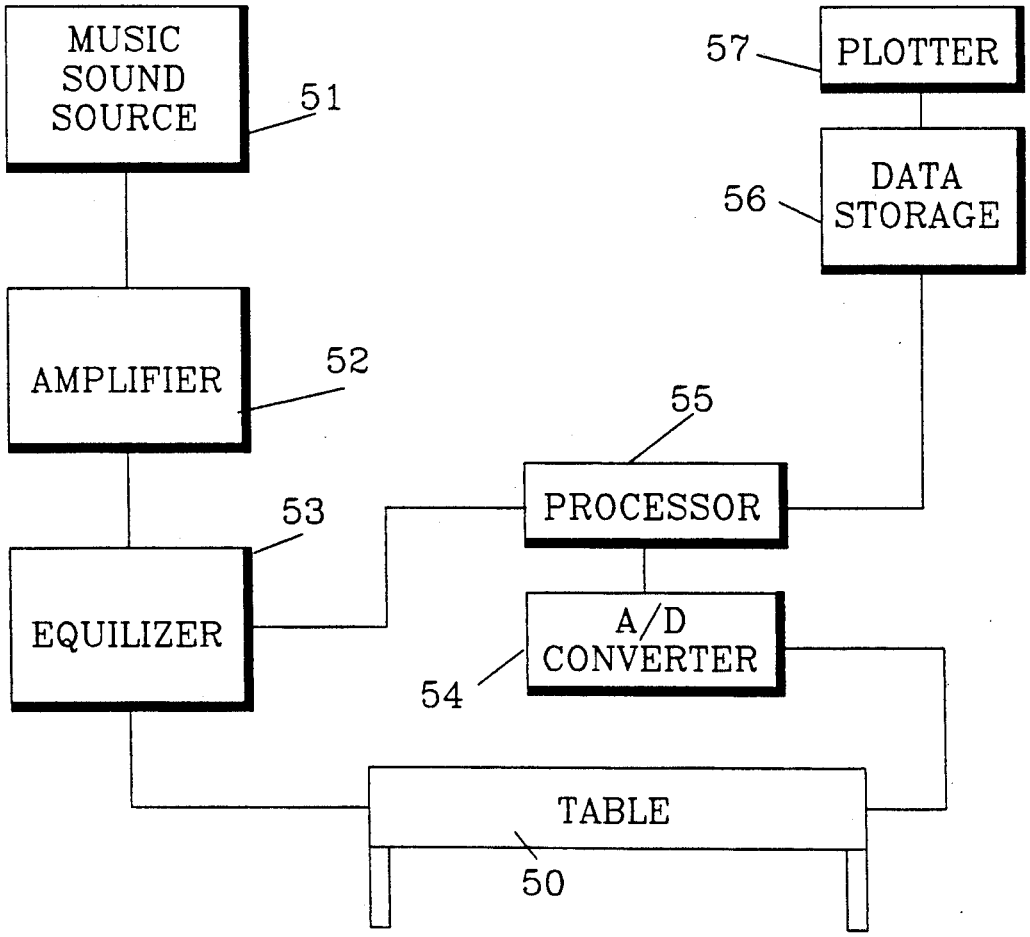
FIG. 5 is a block diagram of the Music Vibration Table System.

FIG. 5 illustrates the data system used in conjunction with the MVT to control vibration to various parts of the table vibrating membrane, and to analyze effects of different frequencies of vibration. Music or sound from source 51 is amplified by amplifier 52. An equalizer is used to emphasize desired frequencies that are determined to be most therapeutic.

The sound or music is applied to the transducers in table 50. Vibrations picked up by sensors (transducers 31 FIGS. 2 and 3) are relayed to A/D converter 54 in the form of an analog voltage produced by sensors/transducers 31. Analog converter 54 digitizes the signals from the various sensors/transducers and, depending upon the frequency desired to be applied to the MVT, adjusts equalizer 53. The signals from the MVT are also analyzed, determining which frequencies applied, when a person is on the MVT, result in the best therapeutic action for that person. This data is stored at 56 and may be plotted out by plotter 57. By analyzing the amplitude of vibrations resulting from the different sensors/transducers of the grid of sensor/transducers, it may be determined what frequencies are desirable to produce vibrations in the various areas of the vibrating membrane to provide the desired therapeutic treatment to the various regions of the body of the person on the MVT.

What is claimed

1. A music vibration table system, comprising:
- a table base;
- at least two transducers for producing vibrations;
- a transducer mounting panel for mounting the transducer on the table base;
- a vibrating membrane;
- a spacing frame for mounting the vibrating membrane over the transducers; and
- sensors connected to the vibrating membrane by a rigid rod to detect vibration amplitudes and frequencies of the membrane at the sensor locations;
- wherein the transducers when stimulated with music or sound produce vibrations in said vibrating membrane.

2. The table system according to claim 1, wherein air is sealed between the vibrating membrane and the transducer mounting table by said spacing frame.

3. The table system according to claim 2, wherein sound waves produced in the air sealed between the vibrating membrane and transducer mounting panel produce the vibration of the vibrating membrane.

4. The table system according to claim 1, wherein the sensors are connected to a processor for analyzing vibrations detected by the sensors to determine vibration frequency and amplitude response of the vibration membrane resulting from different frequencies of music and sound causing membrane vibrations.

5. The table system according to claim 1, including a feedback system to adjust the range of frequencies applied to the transducers.

6. A music vibration table system, comprising:
- a table base;
- a least two transducers for producing vibrations;
- a transducer mounting panel for mounting the transducer on the table base;
- a vibrating membrane;
- a spacing frame for mounting the vibrating membrane over the transducers; and
- a grid of sensors mounted under the vibrating membrane to detect the amplitude of vibration of the membrane at the sensor location.

7. The table system according to claim 6, wherein air is sealed between the vibrating membrane and the transducer mounting table by said spacing frame.

8. The table system according to claim 7, wherein sound waves produced in the air sealed between the vibrating membrane and transducer mounting panel produce the vibration of the vibrating membrane.

9. The table system according to claim 6, wherein the sensors are connected to the vibrating membrane by a rigid rod.

10. The table system according to claim 6, wherein the sensors are connected to a processor for analyzing vibration frequency amplitudes detected by the sensors to determine vibration response of the vibration membrane resulting from different frequencies of music and sound causing membrane vibrations.

11. The table system according to claim 6, including a feedback system to adjust the range of frequencies applied to the transducers.

* * * * *